US012070139B2

(12) United States Patent
Idaszak et al.

(10) Patent No.: US 12,070,139 B2
(45) Date of Patent: Aug. 27, 2024

(54) FIXING DEVICE AND DISPLAY FOR PRODUCTS WITH STICK

(71) Applicant: Perfetti Van Melle S.P.A., Lainate (IT)

(72) Inventors: Lukasz Idaszak, Sroda Wielkopolska (PL); Martin Walzl, Lainate (IT)

(73) Assignee: Perfetti Van Melle S.P.A., Lainate (IT)

( * ) Notice: Subject to any disclaimer, the term of this patent is extended or adjusted under 35 U.S.C. 154(b) by 0 days.

(21) Appl. No.: 18/552,931

(22) PCT Filed: Mar. 30, 2022

(86) PCT No.: PCT/IB2022/052933
§ 371 (c)(1),
(2) Date: Sep. 28, 2023

(87) PCT Pub. No.: WO2022/208380
PCT Pub. Date: Oct. 6, 2022

(65) Prior Publication Data

US 2024/0090683 A1 Mar. 21, 2024

(30) Foreign Application Priority Data

Mar. 31, 2021 (IT) ..... 102021000007991

(51) Int. Cl.
*A47F 7/00* (2006.01)

(52) U.S. Cl.
CPC ..... *A47F 7/0028* (2013.01)

(58) Field of Classification Search
CPC ..... A47F 7/0028; A47F 3/005; Y10T 428/131
See application file for complete search history.

(56) References Cited

U.S. PATENT DOCUMENTS 2,992,012 A * 7/1961 Herold ..... B62B 1/262 280/DIG. 6
3,431,041 A * 3/1969 Fontlladosa ..... A47F 7/0028 426/115
3,456,806 A * 7/1969 Borston ..... A45D 6/00 211/69.5
3,664,617 A * 5/1972 Fenwick ..... F16B 21/06 248/314
4,057,148 A * 11/1977 Meyer ..... B01L 9/06 211/74
4,428,149 A * 1/1984 Brown ..... A63H 27/10 446/222
4,798,554 A 1/1989 Nelson et al.
(Continued)

OTHER PUBLICATIONS

International Preliminary Report on Patentability of PCT/IB2022/052933 issued Jun. 5, 20203.
(Continued)

*Primary Examiner* — Ko H Chan
*Assistant Examiner* — Ko (Korie) H Chan
(74) *Attorney, Agent, or Firm* — Silvia Salvadori, P.C.; Silvia Salvadori

(57) ABSTRACT

A device for the fixing of edible products with stick (10), constituted by a hollow body (1) having an open end (2) suitable for the insertion of the stick (10), a longitudinal cut (4) extending for the entire length of the hollow body, a base (3) at the end opposite to the open end (2), whereto the hollow body is not joined for a portion (6) which extends angularly from the longitudinal cut (4) for an extent comprised between 45° and 180°.

12 Claims, 6 Drawing Sheets

(56) References Cited

U.S. PATENT DOCUMENTS

| | | | | | |
|---|---|---|---|---|---|
| 4,871,074 | A * | 10/1989 | Bryson | A45D 20/12 | 211/70.6 |
| 4,881,916 | A * | 11/1989 | Houser | A63H 27/10 | 446/222 |
| 5,823,364 | A * | 10/1998 | Mucciacciaro | B25H 3/04 | 206/372 |
| 6,202,723 | B1 * | 3/2001 | Maeng | A63B 60/62 | 150/160 |
| 6,345,722 | B1 * | 2/2002 | Wingate | A63B 71/0036 | 473/282 |
| 7,896,173 | B2 * | 3/2011 | Yamamoto | A47B 81/005 | 211/70.2 |
| 2002/0153336 | A1 * | 10/2002 | Wang | A47F 7/0028 | 211/60.1 |
| 2004/0079458 | A1 * | 4/2004 | Maeng | A63B 60/62 | 150/160 |
| 2007/0193965 | A1 * | 8/2007 | Cialdella | A63B 55/00 | 211/70.2 |
| 2014/0021079 | A1 * | 1/2014 | Koller | A61B 50/20 | 206/370 |
| 2021/0289957 | A1 * | 9/2021 | Washington | A47F 5/0018 | |

OTHER PUBLICATIONS

Search Report and Written Opinion of PCT/IB2022/052933 mailed Jun. 13, 2022.

* cited by examiner

FIXING DEVICE AND DISPLAY FOR PRODUCTS WITH STICK

This application is U.S. national stage of PCT/EP2022/052933 filed on 30 Mar. 2022 which claims priority to and the benefit of Italian patent application No. 102021000007991 filed on 31 Mar. 2021, the content of which are all incorporated herein by reference in their entireties.

The invention relates to a device for the fixing of edible products with stick, comprising a hollow body configured in such a way as to adapt to different types of stick.

STATE OF THE ART

Devices for the fixing of products with stick such as those described in CA2132459C, for balloons, flowers or for decorative objects in general, are known, comprising a receptacle and a retention means inside the receptacle that allow sticks of various diameters to be contained for display purposes and guaranteeing a certain stability for the product contained. The problem of these devices is that they require retention means such as a self-adhesive coating or a magnetic element, which can therefore in the former case create an unpleasant sensation for consumers who pick up the product and thus find themselves handling a sticky stick or binds the stick manufacturer to a choice of material that can be attracted by a magnet.

Furthermore, devices for the fixing of edible products such as those described in WO0106897 are known, which allow, thanks to the combined presence of a hollow body of preferably prismatic or trapezoidal shape and of a pin housed inside said hollow body, to firmly fix the products in question to a display without, however, preventing effortless withdrawal thereof by the customer. This device however is suitable for use only for products with a hollow stick and is therefore not useful for all those products with a non-hollow stick.

Referring to edible products with non-hollow stick, other solutions present on the market are known, such as the one shown in FIGS. 1*a* and 1*b*, which provide a diagonal positioning of the sticks inside holes so that the product does not fall from the display, given that the support is not able to hold the sticks firmly in position.

This type of solution exposes part of the sticks and does not allow an adequately dense distribution of products on the display to be obtained.

The simplest and best known solution is that shown in FIG. 1*c*, which allows edible and non-edible products to be displayed vertically, irrespective of the type of stick used, but which has the disadvantage of occupying a very large surface area with respect to the number of products displayed.

All the solutions known and described above also need the product to be inserted into the fixing device by an operative in order to avoid breakage of the stick or incorrect insertion in the cavities, which a robot or in general an automatic filling process would cause.

Therefore, there remains the need to provide fixing devices for edible and non-edible products with stick that are capable of securely holding both hollow and non-hollow sticks, and with different diameters, and the need to provide fixing devices designed for automatic filling by robots and/or automated production lines.

The object of the invention is precisely that of providing a device that meets the abovementioned needs.

This object is achieved by the device for fixing edible products with stick, which has the features of the appended independent claim 1.

Advantageous embodiments of the invention are disclosed in the dependent claims.

The fixing device according to the invention is made up of a hollow body having an open end suitable for inserting the stick, a longitudinal cut extending along the entire length of the hollow body and a base fixed at the end opposite the open end, the hollow body not being fixed to said base for a portion that extends angularly from the longitudinal cut for an extent of between 45° and 180°.

Preferably, the extent of the portion of the hollow body not joined to the base is between 80° and 100°.

Conveniently, an area of reduced thickness is present, located at the end of the portion of the hollow body not attached to the base and extending along the entire length of the hollow body.

BRIEF DESCRIPTION OF THE DRAWINGS

Further features of the invention will be made clearer by the following detailed description, referred to an embodiment of the invention purely by way of example and therefore not limiting, illustrated in the accompanying drawings, in which.

DETAILED DESCRIPTION OF PREFERRED EMBODIMENTS OF THE INVENTION

Figure 1A:
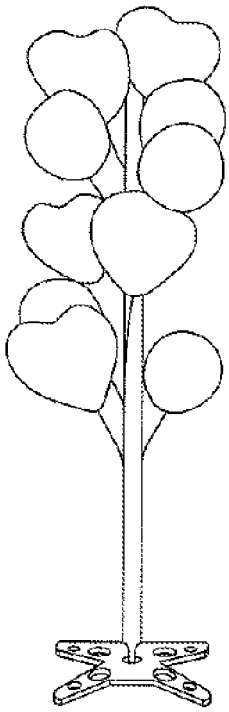
FIGS. 1*a*, 1*b*, 1*c* are schematic views of displays of products with stick using fixing devices according to the prior art.
Figure 1B:
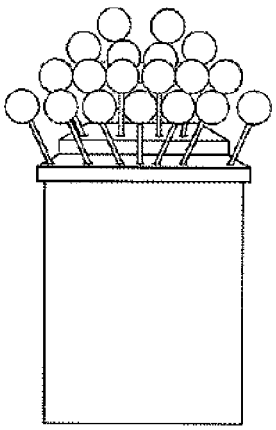
Figure 1C:
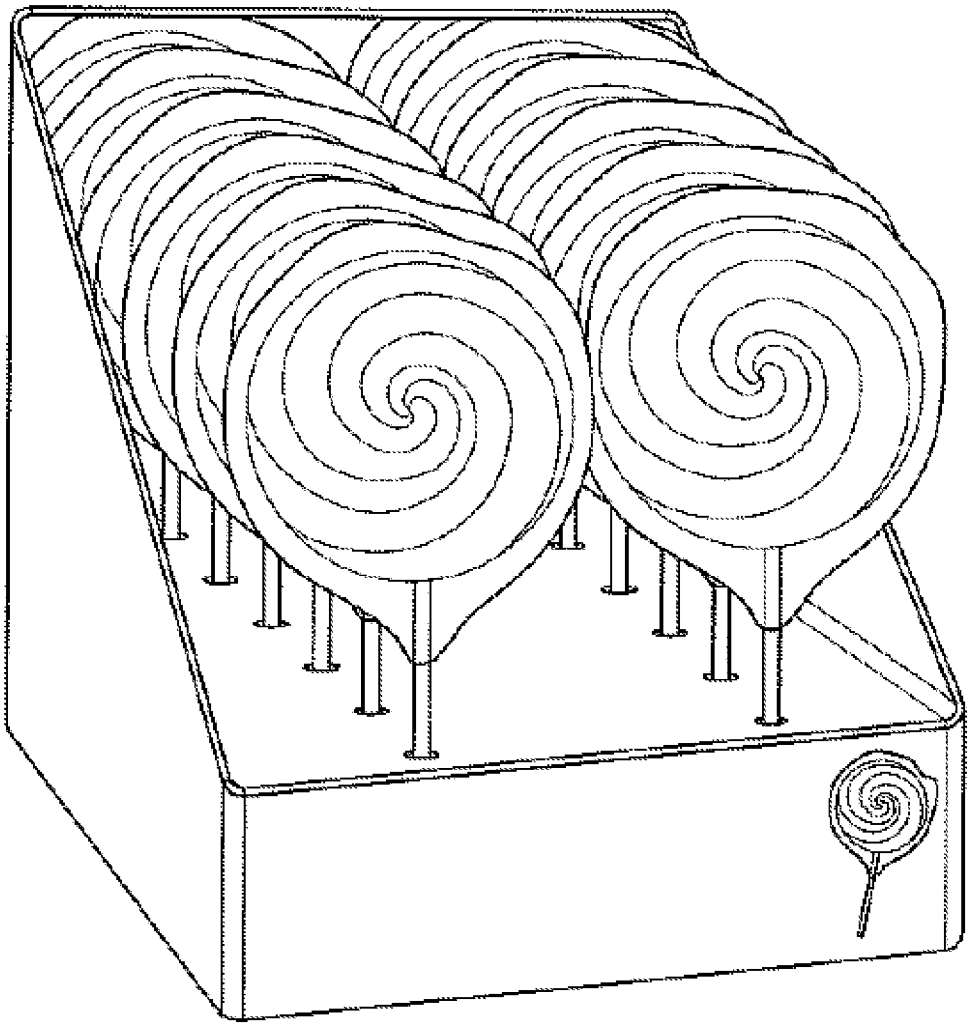
Figure 2:
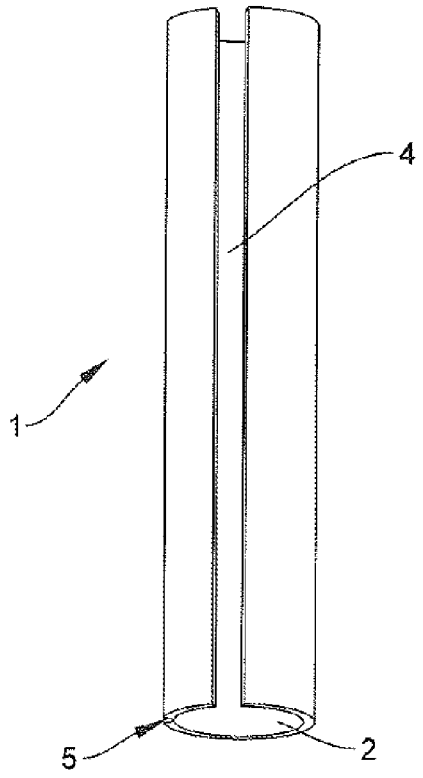
FIG. 2 is a schematic axonometric view of a fixing device according to the invention, in which the base is also not shown.
Figure 3:
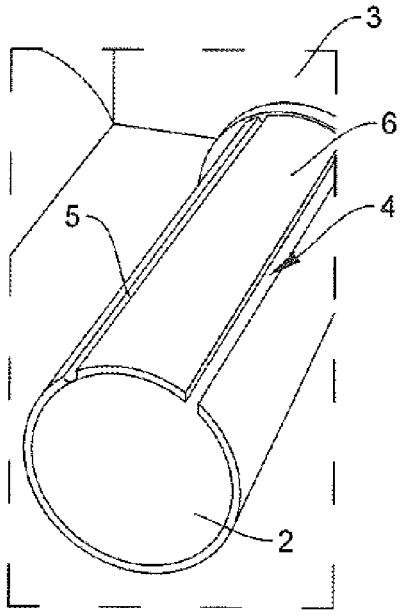
FIGS. 3, 4 and 5 are perspective views from different angles of the device of FIG. 2, showing the base fixed to the hollow body, a portion of the hollow body that extends angularly from the longitudinal cut for an extent of between 45° and 180° not fixed to the base, and a thinned area.
Figure 4:
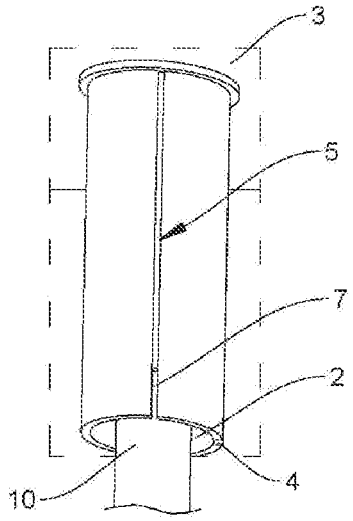
Figure 5:
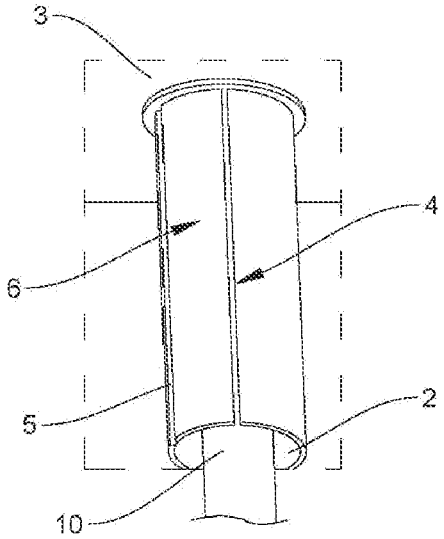

The device for fixing edible products with stick according to the invention is made up of a hollow body 1 having an open end 2 suitable for inserting the stick 10 of the product (FIGS. 4, 5), and a base 3 fixed to the other end (FIGS. 3-5).

Figure 7:
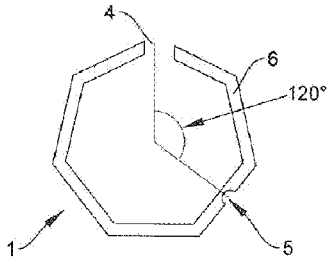
FIG. 7 is a cross section view of a device according to the invention, with polygonal configuration.

The abovementioned hollow body 1 preferably has a cylindrical tubular shape with a circular section, but may have any polygonal shape, as shown, for example, in FIG. 7, and is characterised by a longitudinal cut 4 and an area of reduced thickness 5 which also extends, like the cut, along the entire length of the hollow body 1. The area of reduced thickness 5 is placed at a certain distance from the longitudinal cut 4 so as to create between the longitudinal cut and the area of reduced thickness a sort of wing 6 of the desired width and having the object of allowing the hollow body 1 to adapt to different types of stick 10, maintaining, thanks to its elasticity and spring effect, a capacity for retaining the stick itself.

This elasticity is due to the fact that the hollow body 1 is not completely attached to the base 3 but its wing-shaped portion 6, which goes from the longitudinal cut 4 to the area of reduced thickness 5, is detached from it.

The portion 6 of the hollow body 1 detached from the base 3, which extends from the longitudinal cut 4 to the area of reduced thickness 5, may have an angle of different degrees from a minimum of 45° to a maximum of 180°, preferably between 80° and 100°, in order to allow the flexible element 6 to obtain the correct extent of movement but without compromising the capacity thereof for retention of the product.

Figure 6A:
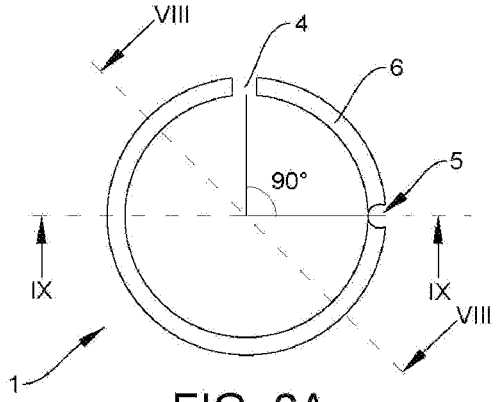
FIGS. 6*a*, 6*b*, 6*c* are cross section views of the device of the preceding drawings, in the rest condition and in two different conditions of use, respectively.
Figure 6B:
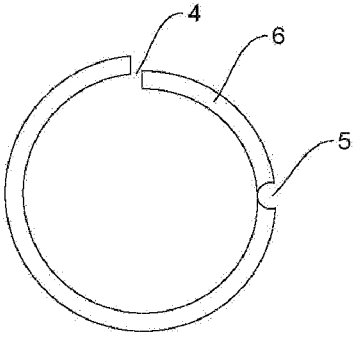
Figure 6C:
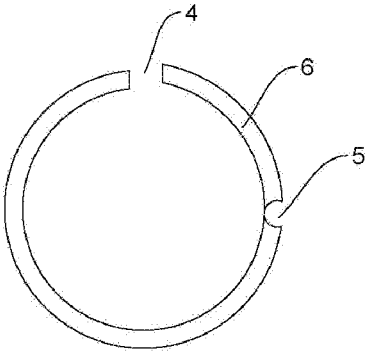

FIGS. 6*a*, 6*b*, 6*c* show the area of reduced thickness 5 at an angular distance of 90° from the longitudinal cut 4 of a hollow body 1 with circular section. More particularly, FIG. 6*a* shows the flexible element 6 in rest conditions, that is, housing a stick 10 having a diameter substantially corresponding to the internal diameter of the hollow body 1, while FIGS. 6*b* and 6*c* show, respectively, the positions taken by the flexible element 6 in the case of a stick 10 having a smaller or greater diameter.

FIG. 7 shows the area of reduced thickness 5 at an angular distance of approximately 120° from the longitudinal cut 4 of a hollow body 1 with polygonal section.

In proximity of the mouth, i.e. the open end 2 of insertion of the stick 10 in the hollow body 1, the area of reduced thickness 5 may optionally become a cut 7 (FIG. 4) that extends for part of the length of this area of reduced thickness, in order to increase the flexibility of the flexible element 6.

The cut may extend, in a preferred embodiment of the invention, up to half the length of the area of reduced thickness 5. In an even more preferred embodiment the cut extends up to one third of the length of the area of reduced thickness.

Figure 8:
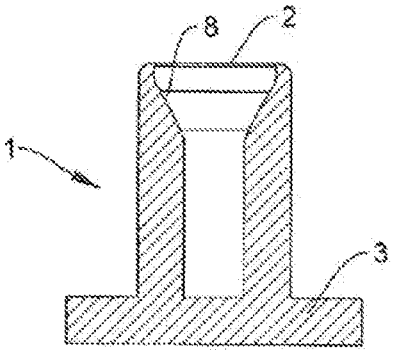
FIG. 8 is a schematic view in axial section of a device according to the invention, taken along plane VIII-VIII of FIG. 6*a*, in which the mouth for the insertion of the sticks in the hollow body has a funnel-shaped conformation.
Figure 9:
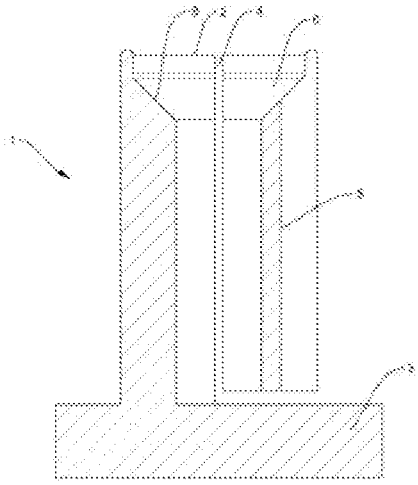
FIG. 9 is an axial section like that of FIG. 8, taken along plane IX-IX of FIG. 6*a* passing through the thinned area and looking towards the longitudinal cut.

The mouth or open end 2 of the hollow body 1 in its initial part may only present itself internally as having a funnel-like conformation 8 (FIGS. 8 and 9) in order to facilitate filling of the hollow body by robots or automated production lines.

By way of example only, preferred dimensions of a cylindrical hollow body 1 with circular section of the fixing device according to the invention are given below:

| | |
|---|---|
| inner diameter: | 3.9 mm |
| outer diameter: | 9.7 mm |
| height: | 19.92 mm |
| thickness: | 2.9 mm |
| width of longitudinal cut 4: | 1.43 mm |
| width of reduced thickness 5: | 0.8 mm |

The base 3 of the hollow body may be formed directly by the body of the display of the products or the fixing device may be made in one or a plurality of examples having a shape of the base suitable for being applied on any surface of a display provided with appropriate housings.

The fixing device 1 is made in an elastic material preferably polypropylene, polyethylene and polyesters. Biodegradable plastics or plastics of natural origin may be used as well as mixtures of different plastic materials to develop the mechanical properties of the support. The choice of material together with the other aspects of the invention described enable the inner diameter of the hollow body to adapt to the outer diameter of the stick, thus enabling a sufficiently strong grip of the fixing device on the stick to prevent the product from falling off even when the sticks are in a horizontal position.

From what has been disclosed, the advantages of the device according to the invention appear clear, which makes it possible to securely fix hollow and solid sticks of different diameters.

Naturally, the invention is not limited to the particular embodiments illustrated, but numerous detailed changes may be made thereto within the reach of the person skilled in the art, without thereby departing from the scope of the invention itself, as defined in the following claims.

The invention claimed is:

1. A device for the fixing of edible products with stick (10), said device consisting of a hollow body (1) having an open end (2) suitable for insertion of the stick (10) and a base (3) fixed at the end opposite to the open end, a longitudinal cut (4) extending for the entire length of the hollow body, wherein an area of reduced thickness (5) which extends along the entire length of the hollow body (1) and is placed at an angular distance from the longitudinal cut between 45° and 180°, creating between the longitudinal cut and the area of reduced thickness a wing-shaped portion (6) not fixed to said base, allowing the hollow body to adapt to different type of sticks (10).

2. Device according to claim 1, wherein said area of reduced thickness (5) is placed at an angular distance from said longitudinal cut between 80° and 100°.

3. Device according to claim 1, wherein the area of reduced thickness (5) has a further cut (7) at the open end (2) of the hollow body (1).

4. Device according to claim 3, wherein said further cut (7) of the area of reduced thickness (5) extends up to half of its length.

5. Device according to claim 3, wherein said further cut (7) of the area of reduced thickness (5) extends up to one third of its length.

6. Device according to claim 1, wherein the hollow body (1) at said open end (2) has a mouth in a shape of a funnel (8).

7. Device according to claim 1, made of elastic material.

8. Display of edible products with stick (10) provided with housings suitable for accommodating the base (3) of a device for the fixing of edible products with stick according to claim 1.

9. Display of edible products with stick (10) having a body integrating the base (3) of a plurality of devices for the fixing of edible products with stick according to claim 1.

10. Use of the device according to claim 1 as modular element for forming a display of edible products with stick.

11. Device according to claim 7, wherein said elastic material is polypropylene, polyethylene or polyesters.

12. A device for the fixing of edible products with stick, comprising:

a hollow body having an open end suitable for insertion for the stick and a base; said hollow body having a tubular shape and comprising a longitudinal cut extending for the entire length of the hollow body and an area of reduced thickness with extends along the entire length of the hollow body, said area of reduced thickness being placed at an angular distance from the longitudinal cut, a wing-shaped portion being defined in said hollow body between said longitudinal cut and said area of reduced thickness, said hollow body being partially fixed to said base at the end opposite to the open end, said wing-shaped portion of said hollow body being detached from said base.

* * * * *